US010508465B2

(12) United States Patent
Pan et al.

(10) Patent No.: US 10,508,465 B2
(45) Date of Patent: Dec. 17, 2019

(54) DETACHABLE BASE

(71) Applicant: Zhejiang Yotrio Group Co., Ltd., Linhai (CN)

(72) Inventors: Jiangbo Pan, Linhai (CN); Jianping Xie, Linhai (CN)

(73) Assignee: ZHEJIANG YOTRIO GROUP CO., LTD., Linhai (CN)

( * ) Notice: Subject to any disclaimer, the term of this patent is extended or adjusted under 35 U.S.C. 154(b) by 0 days.

(21) Appl. No.: 15/985,732

(22) Filed: May 22, 2018

(65) Prior Publication Data

US 2018/0334828 A1 Nov. 22, 2018

(30) Foreign Application Priority Data

May 22, 2017 (CN) ..... 2017 2 0570758 U

(51) Int. Cl.
*E04H 12/22* (2006.01)
*A45B 23/00* (2006.01)

(52) U.S. Cl.
CPC .. *E04H 12/2246* (2013.01); *A45B 2023/0012* (2013.01)

(58) Field of Classification Search
CPC ..... E04H 12/2246; A45B 2023/0012
USPC ..... 248/519, 526, 123.2, 406.2, 182.1, 910
See application file for complete search history.

(56) References Cited

U.S. PATENT DOCUMENTS 3,415,475 A * 12/1968 Goodman ..... F16M 11/22 248/158
6,305,659 B1 * 10/2001 Metelski ..... F16M 11/42 248/519
6,446,930 B1 * 9/2002 Li ..... E04H 12/2238 135/15.1
6,869,058 B2 * 3/2005 Tung ..... E04H 12/2238 248/519
2004/0056169 A1 * 3/2004 Harbaugh ..... E04H 12/2246 248/519
2005/0023428 A1 * 2/2005 Woude ..... E04H 12/2246 248/530
2005/0189005 A1 * 9/2005 Smith ..... E04H 12/2246 135/16
2008/0224016 A1 * 9/2008 Defu ..... E04H 12/2246 248/523
2012/0024330 A1 * 2/2012 Ma ..... A45B 23/00 135/16

(Continued)

*Primary Examiner* — Muhammad Ijaz
(74) *Attorney, Agent, or Firm* — Schwegman Lundberg & Woessner, P.A.

(57) ABSTRACT

A detachable base includes a pedestal, a counterweight box mounted on the pedestal, and a shell detachably covered on the counterweight box and the pedestal. The shell includes an edge, a corner having a smooth transition camber surface, and a cover. The edge is detachably connected to the cover. A side edge vertical to the corner is provided with a first fitting portion of a fastening part. A vertical side edge of the edge corresponding to the corner is provided with a second fitting portion of a fastened part. The first fitting portion fits with the second fitting portion through socketing. The counterweight box, the detachable shell and the pedestal of the invention allow the whole detachable base to be disassembled into small-sized parts easy to take and pack, or to be assembled, as spare parts, together with other accessories of the sunshade.

8 Claims, 4 Drawing Sheets

(56) References Cited

U.S. PATENT DOCUMENTS

| | | | | |
|---|---|---|---|---|
| 2013/0146739 | A1* | 6/2013 | Zhao | E04H 12/2246 248/519 |
| 2013/0146740 | A1* | 6/2013 | Ma | F16M 13/00 248/519 |
| 2016/0123522 | A1* | 5/2016 | Hahn | A63B 71/023 248/523 |
| 2018/0334828 | A1* | 11/2018 | Pan | E04H 12/2246 |

* cited by examiner

DETACHABLE BASE

CROSS-REFERENCE TO RELATED APPLICATIONS

This Non-provisional application claims priority under 35 U.S.C. § 119(a) on Patent Application No(s). 2017/20570758.8 filed in People's Republic of China on May 22, 2017, the entire contents of which are hereby incorporated by reference.

BACKGROUND OF THE INVENTION

Field of the Invention

The invention relates to the field of sunshade accessories, and more particularly, to a detachable base.

Description of the Related Art

Sunshades are sun-protecting tools frequently used outdoors. Existing sunshades are large in size because counterweights and shells of pedestals are connected together. During assembly, the pedestals and other parts such as umbrella ribs generally are separately packed, which leads to problems that users often forget to buy accessories of the pedestals. Furthermore, the whole sunshades are heavier, which leads to arduous assembly.

BRIEF SUMMARY OF THE INVENTION

Aiming at the above problems, the invention provides a detachable base to solve the problems that the existing sunshades have the defects of separate package and arduous assembly due to larger sizes of the pedestals of the existing sunshades.

The invention adopts the following technical solutions.

A detachable base includes: a pedestal;

a counterweight box, mounted on the pedestal and used for increasing a downward pressure of the pedestal; and a shell, detachably covered on the counterweight box and the pedestal; the shell comprising an edge, a corner having a smooth transition camber surface, and a cover; the edge being detachably connected to the cover; a side edge vertical to the corner being provided with a first fitting portion of a fastening part; a vertical side edge of the edge corresponding to the corner being provided with a second fitting portion of a fastened part, and the first fitting portion fitting with the second fitting portion through socketing so that the fastening part is pressed against the fastened part to implement fixation. The counterweight box, the detachable shell and the pedestal of the invention allow the whole detachable base to be disassembled into small-sized parts easy to take and pack, or to be assembled, as spare parts, together with other accessories of the sunshade. Furthermore, the relatively lightweight small-sized parts are easy for one-man operation and assembly.

Optionally, a horizontal side edge of the edge may be provided with a through hole, and underneath a position of the cover corresponding to the edge there may be provided with a hook bending to form a hook groove. The through hole may be internally inserted with a rotor in running fit with the through hole. The rotor may include a rotary column and a rotating piece. The rotating piece may be positioned at an end of the rotary column, and an end of the rotating piece may be provided with a clasp arm. The rotor may rotate to drive the clasp arm to insert into the hook groove to implement fixation or depart from the hook groove to implement separation. An external surface of an end of the rotary column away from the rotating piece may be provided with a strip-shaped groove.

Optionally, the through hole may be internally inserted with a rotor in running fit with the through hole. The rotor may include a rotary column and a rotating piece. The rotating piece may be positioned at an end of the rotary column, and an end of the rotating piece may be provided with a clasp arm. The rotor may rotate to drive the clasp arm to insert into the hook groove to implement fixation or depart from the hook groove to implement separation. An external surface of an end of the rotary column away from the rotating piece may be provided with a strip-shaped groove.

Optionally, the counterweight box may be provided with a rotatable box cover and a box body which may connect the box cover. An outer side edge of the box cover may be provided with an engaging portion, an edge corresponding to the box body may be provided with an engaged portion, and the engaging portion may fit with the engaged portion so that the box cover may hermetically cover the box body.

Optionally, the counterweight box may be made of a flexible material, and the counterweight box may be filled with solid powder having fluidity.

Optionally, a bottom of the box body may be provided with a first clasp groove which may fit to a fixing rod in shape.

Optionally, the first fitting portion may be a lug, and the second fitting portion may be a second clasp groove which may fit to the lug.

Optionally, the pedestal may include a cross-shaped chassis which may be composed of a pair of intersecting fixing rods and a rotary seat which may be detachably mounted at a center of the chassis. A bottom of the rotary seat may be provided with a cross-shaped groove. The cross-shaped groove may be used so that the bottom of the rotary seat may be slidably inserted into the cross-shaped chassis to implement fixation.

Optionally, the detachable base may further include a support frame which may be fixed to a pair of the fixing rods or a bottom of the counterweight box. The support frame may be used for supporting the counterweight box.

Optionally, the shell may be provided with a groove hole which may fit to an outer side edge of a rotary seat.

Beneficial effects of the invention are as below: the counterweight box, the detachable shell and the pedestal of the invention allow the whole detachable base to be disassembled into small-sized parts easy to take and pack, or to be assembled, as spare parts, together with other accessories of the sunshade. Furthermore, the relatively lightweight small-sized parts are easy for one-man operation and assembly.

Figure 1:
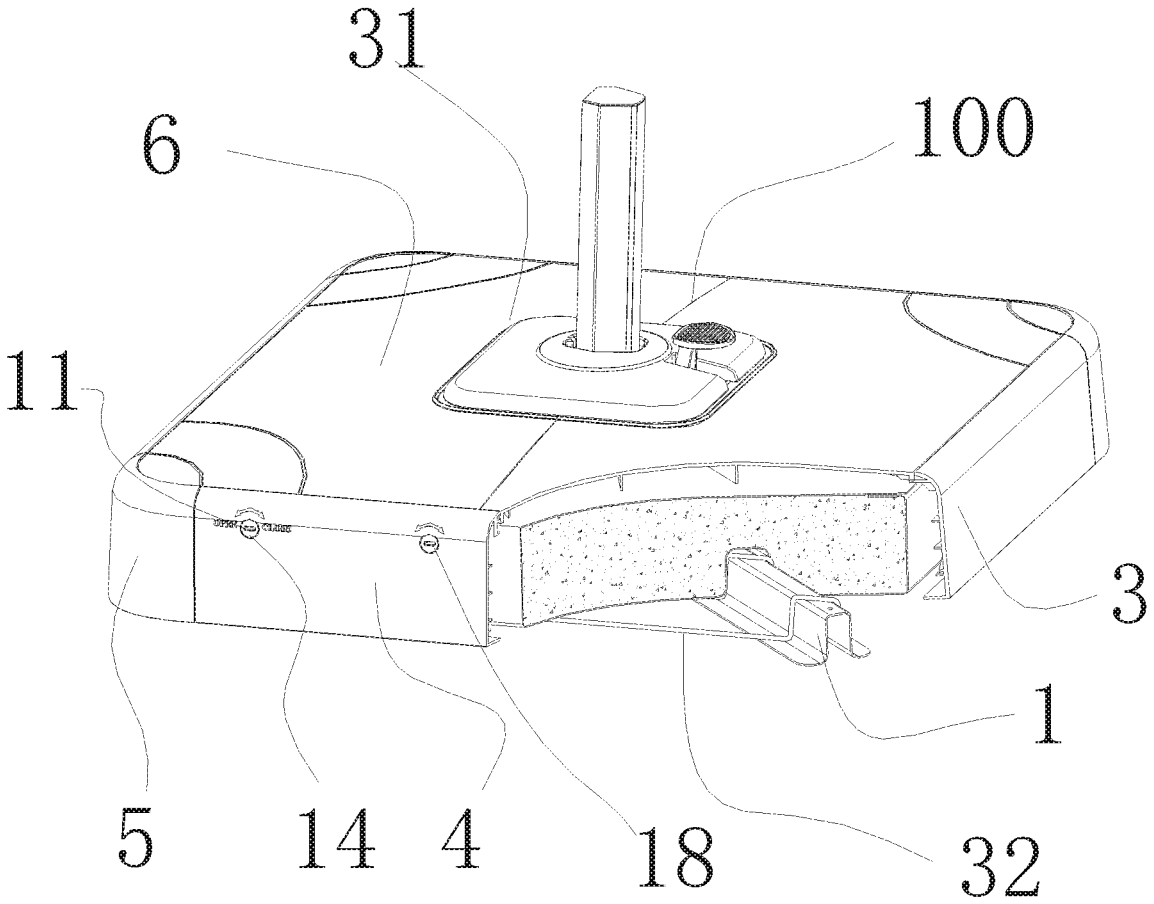
FIG. 1 is a schematic diagram illustrating overall and partial sectional structures of a detachable base according to the invention.

Reference numerals in the figures are as below:

1 pedestal; 2 counterweight box; 3 shell; 4 edge; 5 corner; 6 cover; 7 fastening part; 8 first fitting portion; 9 fastened part; 10 second fitting portion; 11 through hole; 12 hook; 13 hook groove; 14 rotor; 15 rotary column; 16 rotating piece; 17 clasp arm; 18 strip-shaped groove; 19 fixing rod; 20 rotary seat; 21 cross-shaped groove; 22 chassis; 31 groove hole; 32 support frame; 33 box cover; 34 box body; 35 engaging portion; 36 engaged portion; 41 second clasp groove; and 100 detachable base.

DETAILED DESCRIPTION OF THE INVENTION

The invention is described in detail below with reference to the accompanying drawings.

Figure 2:
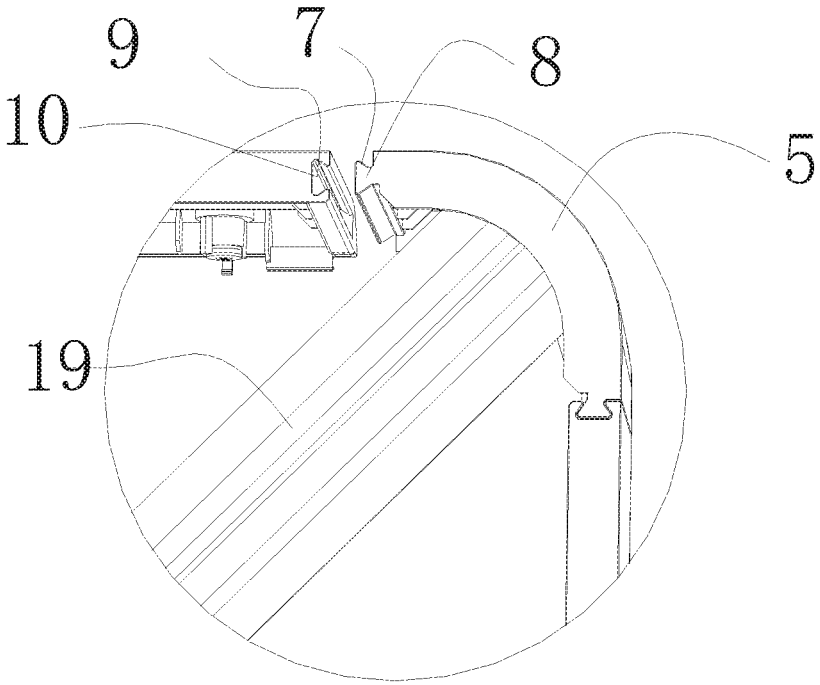
FIG. 2 is a schematic diagram illustrating a vertical view of a partial structure of the detachable base.
Figure 3:
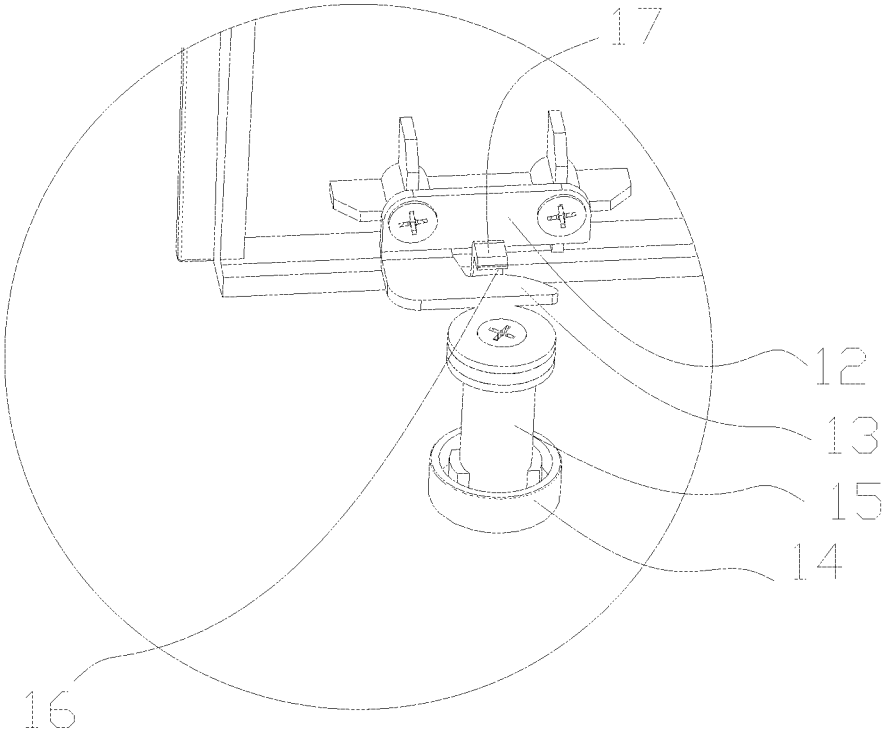
FIG. 3 is a schematic diagram illustrating an assembly structure of a rotor of an edge of the detachable base.
Figure 4:
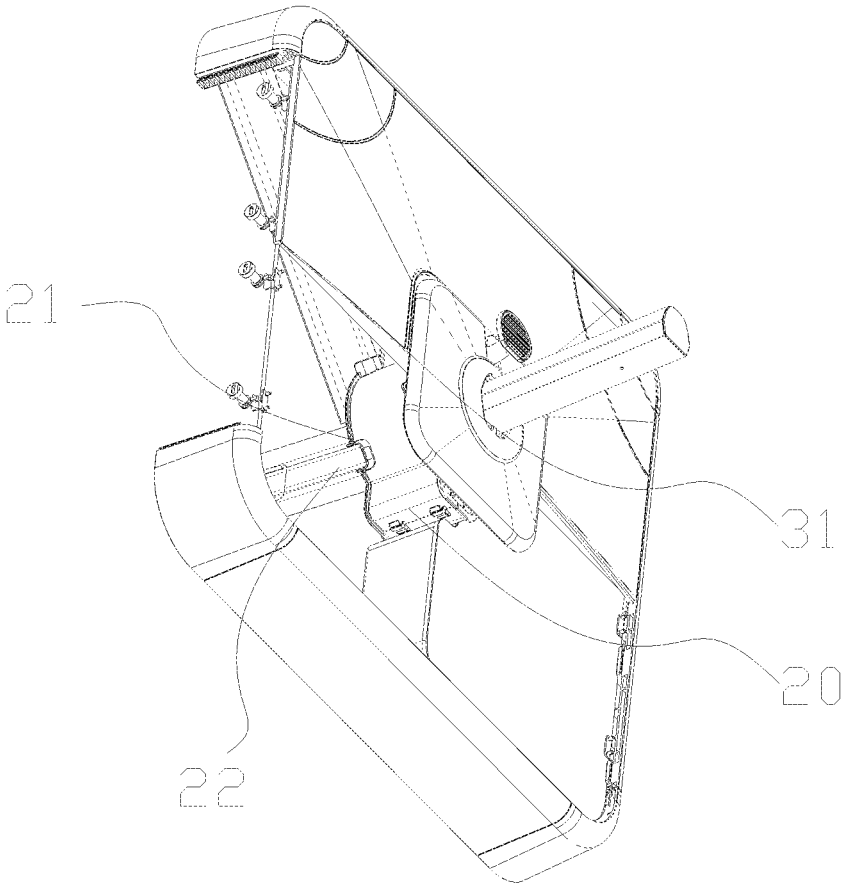
FIG. 4 is a schematic structural diagram of a chassis of the detachable base.
Figure 5:
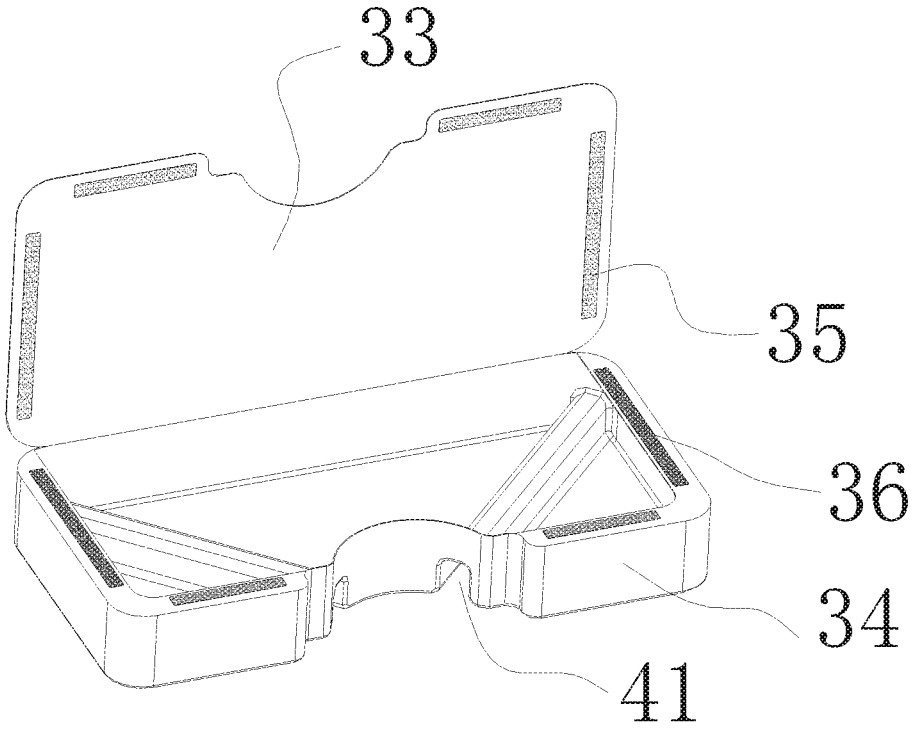
FIG. 5 is a schematic structural diagram of a counterweight box of the detachable base.
Figure 6:
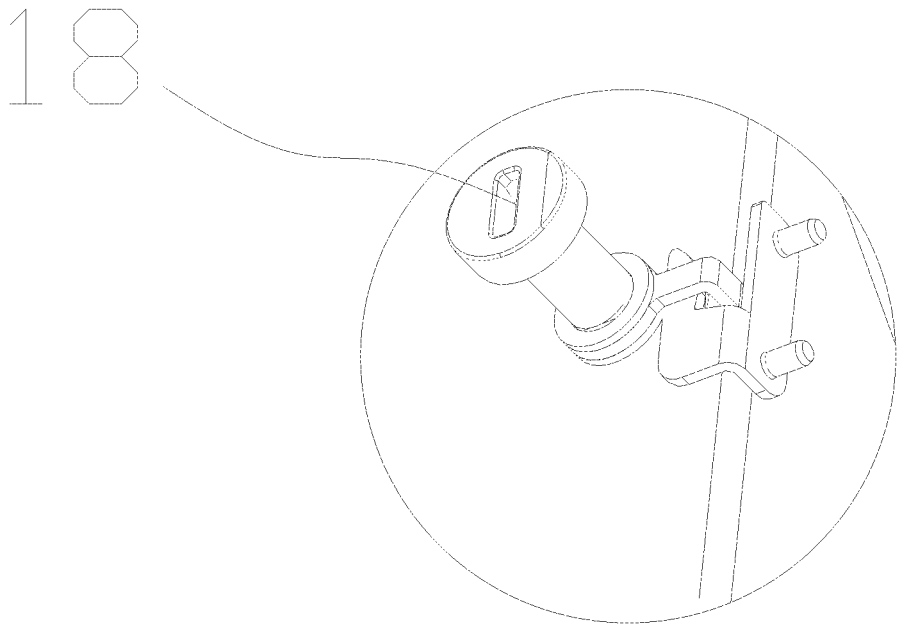
FIG. 6 is a schematic diagram illustrating a partial structure of the detachable base.

The invention discloses a detachable base 100 (referring to FIG. 1-FIG. 6), including: a pedestal 1; a counterweight box 2, mounted on the pedestal 1 and used for increasing a downward pressure of the pedestal 1; and a shell 3, detachably covered on the counterweight box 2 and the pedestal 1. The shell 3 includes an edge 4, a corner 5 having a smooth transition camber surface, and a cover 6. The edge 4 is detachably connected to the cover 6. A side edge vertical to the corner 5 is provided with a first fitting portion 8 of a fastening part 7. A vertical side edge of the edge 4 corresponding to the corner 5 is provided with a second fitting portion 10 of a fastened part 9. The first fitting portion 8 fits with the second fitting portion 10 through socketing so that the fastening part 7 is pressed against the fastened part 9 to implement fixation. The counterweight box 2, the detachable shell 3 and the pedestal 1 of the invention allow the whole detachable base 100 to be disassembled into small-sized parts easy to take and pack, or to be assembled, as spare parts, together with other accessories of the sunshade. Furthermore, the relatively lightweight small-sized parts are easy for one-man operation and assembly.

A horizontal side edge of the edge 4 is provided with a through hole 11. Underneath a position of the cover 6 corresponding to the edge 4 there is provided with a hook 12 bending to form a hook groove 13. The through hole 11 is internally inserted with a rotor 14 in running fit with the through hole 11. The rotor 14 includes a rotary column 15 and a rotating piece 16. The rotating piece 16 is positioned at an end of the rotary column 15, and an end of the rotating piece 16 is provided with a clasp arm 17. The rotor 14 rotates to drive the clasp arm 17 to insert into the hook groove 13 to implement fixation or depart from the hook groove 13 to implement separation. An external surface of an end of the rotary column 15 away from the rotating piece 16 is provided with a strip-shaped groove 18.

The through hole 11 is internally inserted with a rotor 14 in running fit with the through hole 11. The rotor 14 includes a rotary column 15 and a rotating piece 16. The rotating piece 16 is positioned at an end of the rotary column 15, and an end of the rotating piece 16 is provided with a clasp arm 17. The rotor 14 rotates to drive the clasp arm 17 to insert into the hook groove 13 to implement fixation or depart from the hook groove 13 to implement separation. An external surface of an end of the rotary column 15 away from the rotating piece 16 is provided with a strip-shaped groove 18.

The counterweight box 2 is provided with a rotatable box cover 33 and a box body 34 connecting the box cover 33. An outer side edge of the box cover 33 is provided with an engaging portion 35, an edge corresponding to the box body 34 is provided with an engaged portion 36, and the engaging portion 35 fits with the engaged portion 36 so that the box cover 33 hermetically covers the box body 34. Multiple structures may be adopted for manners of sealing the box cover 33 and the box body 34 of the counterweight box 2 of the invention, including spare parts having disassembling and engaging functions such as Velcro tapes, zippers and sticking membranes. Using the above spare parts is a modification of equivalent structures of the engaging portion 35 and the engaged portion 36 of the invention.

The counterweight box 2 is made of a flexible material, and the counterweight box 2 is filled with solid powder having fluidity. A bottom of the box body 34 is provided with a first clasp groove fitting to a fixing rod 19 in shape. The first fitting portion 8 is a lug, and the second fitting portion 10 is a second clasp groove 41 fitting to the lug.

The pedestal 1 includes a cross-shaped chassis 22 composed of a pair of intersecting fixing rods 19 and a rotary seat 20 detachably mounted at a center of the chassis 22. A bottom of the rotary seat 20 is provided with a cross-shaped groove 21. The cross-shaped groove 21 is used so that the bottom of the rotary seat 20 is slidably inserted into the cross-shaped chassis 22 to implement fixation.

The detachable base 100 further includes a support frame 32 fixed to a pair of the fixing rods 19 or a bottom of the counterweight box 2. The support frame 32 is used for supporting the counterweight box 2. The shell 3 is provided with a groove hole 31 fitting to an outer side edge of a rotary seat 20.

When the invention is implemented, the lug is slidably inserted into the first clasp groove during installation so that the fastening part is pressed against the fastened part to implement fixation. Relative fixation of the corner and the edge is implemented. By rotating the strip-shaped groove, the rotor rotates to drive the clasp arm to insert into the hook groove so as to implement fixation of the edge and the cover. In this way, the box body is assembled. The rotary seat is placed on the cross-shaped chassis to complete the assembly of the pedestal. The box cover hermetically covers the box body, and the counterweight box is mounted on the pedestal. The shell is covered on the counterweight box and the pedestal to complete the assembly of the detachable base.

The above are merely preferred embodiments of the invention and are not intended to limit the scope of patent protection of the invention. Any modifications of equivalent structures made on the basis of the contents of the description and accompanying drawings of the invention or directly or indirectly applied to other related technical fields shall similarly fall within the scope of protection of the invention.

What is claimed is:

1. A detachable base, comprising:

a pedestal;

a counterweight box, mounted on the pedestal and used for increasing a downward pressure of the pedestal, the counterweight box including a rotatable box cover and a box body, an outer side edge of the box cover is provided with an engaging portion, an edge corresponding to the box body is provided with an engaged portion, and the engaging portion fits with the engaged portion so that the box cover hermetically covers the box body; and a shell, detachably covered on the counterweight box and the pedestal; the shell comprising an edge, a comer having a smooth transition camber surface, and a cover;

the edge being detachably connected to the cover; a side edge vertical to the corner being provided with a first fitting portion of a fastening part; a vertical side edge of the edge corresponding to the corner being provided with a second fitting portion of a fastened part, and the first fitting portion fitting with the second fitting portion through socketing so that the fastening part is pressed against the fastened part to implement fixation.

2. The detachable base according to claim 1, wherein a horizontal side edge of the edge is provided with a through hole, underneath a position of the cover corresponding to the edge there is provided with a hook bending to form a hook groove; and the through hole is internally inserted with a rotor in running fit with the through hole; the rotor comprises a rotary column and a rotating piece, wherein the rotating piece is positioned at an end of the rotary column, an end of the rotating piece is provided with a clasp arm, the rotor rotates to drive the clasp arm to insert into the hook groove to implement fixation or depart from the hook groove to implement separation; and an external surface of the end of the rotary column away from the rotating piece is provided with a strip-shaped groove.

3. The detachable base according to claim 1, wherein the counterweight box is made of a flexible material, and the counterweight box is filled with solid powder having fluidity.

4. The detachable base according to claim 1, wherein a bottom of the box body is provided with a first clasp groove fitting to a fixing rod in shape.

5. The detachable base according to claim 1, wherein the first fitting portion is a lug, and the second fitting portion is a second clasp groove fitting to the lug.

6. The detachable base according to claim 1, wherein the pedestal comprises a cross-shaped chassis composed of a pair of intersecting fixing rods and a rotary seat detachably mounted at a center of the chassis; a bottom of the rotary seat is provided with a cross-shaped groove; and the cross-shaped groove is used so that the bottom of the rotary seat is slidably inserted into the cross-shaped chassis to implement fixation.

7. The detachable base according to claim 6, further comprising a support frame fixed to a pair of the fixing rods or a bottom of the counterweight box, wherein the support frame is used for supporting the counterweight box.

8. The detachable base according to claim 1, wherein the shell is provided with a groove hole fitting to an outer side edge of a rotary seat.

* * * * *